US007240796B2

(12) United States Patent
Murray

(10) Patent No.: US 7,240,796 B2
(45) Date of Patent: Jul. 10, 2007

(54) PACKAGING RELEASE VALVE FOR REFRIGERATED FOOD ITEMS

(75) Inventor: R. Charles Murray, Sarasota, FL (US)

(73) Assignee: PPi Technologies, Inc., Sarasota, FL (US)

( * ) Notice: Subject to any disclaimer, the term of this patent is extended or adjusted under 35 U.S.C. 154(b) by 205 days.

(21) Appl. No.: 10/967,547

(22) Filed: Oct. 18, 2004

(65) Prior Publication Data

US 2005/0082195 A1 Apr. 21, 2005

Related U.S. Application Data

(60) Provisional application No. 60/511,789, filed on Oct. 16, 2003.

(51) Int. Cl.
*B65D 81/20* (2006.01)
*B65D 81/34* (2006.01)
*F16K 15/14* (2006.01)

(52) U.S. Cl. ..... 206/550; 137/246; 137/516.13; 383/103; 426/107; 426/113; 426/118

(58) Field of Classification Search ..... 383/100–103; 137/246, 854, 859, 533–540, 516.13; 426/107, 426/113, 118, 234
See application file for complete search history.

(56) References Cited

U.S. PATENT DOCUMENTS

| | | | | |
|---|---|---|---|---|
| 4,444,219 | A | 4/1984 | Hollenstein | |
| 5,354,133 | A * | 10/1994 | Rapparini | 383/103 |
| 6,089,271 | A * | 7/2000 | Tani | 137/854 |
| 6,380,524 | B1 | 4/2002 | Keller | |
| 6,607,764 | B1 | 8/2003 | Keller | |
| 6,776,301 | B2 * | 8/2004 | Torres-White et al. | 220/203.17 |

* cited by examiner

*Primary Examiner*—Bryon P. Gehman
(74) *Attorney, Agent, or Firm*—Gifford, Krass, Sprinkle, Anderson & Citkowski, P.C.

(57) ABSTRACT

A valve assembly is provided for venting pressurized gases generated from within an enclosed package during a heating of the package. The valve assembly has a membrane element, a tubular body and a retaining member. The tubular body has an open end, a closed end and a recess defined therebetween. The closed end has an aperture for venting the pressurized gases therethrough. The recess is operative to receive and support the membrane element adjacent the closed end. The retaining member is operative for snap-fit engagement with the tubular body for retaining the membrane element within the recess.

16 Claims, 4 Drawing Sheets

PACKAGING RELEASE VALVE FOR REFRIGERATED FOOD ITEMS

RELATED APPLICATION

This application claims priority of U.S. Provisional Patent Application Ser. No. 60/511,789 filed Oct. 16, 2003, which is incorporated herein by reference.

BACKGROUND OF THE INVENTION

1. Field of the Invention

The invention relates to a release valve for use with packaging of food items. More particularly, the invention relates to a release valve that relieves pressure generated during a heating of the package in an oven.

2. Description of the Related Art

Food items are commonly stored in packaging allowing the food items to be warmed or cooked in an oven while remaining sealed within the packaging. Typically, the packaging includes a molded plastic container and a flexible sealing film adhesively secured along a lip of the container. Instructions are usually provided directing the user to puncture holes in the sealing film allowing venting of pressurized gases generated within the packaging during heating in the oven. But, many users ignore such instructions potentially resulting in packaging that ruptures or bursts from the build-up of excess pressure.

Pressure release valves are known for relieving pressure generated within a package. An example of such a valve is provided in U.S. Pat. No. 4,444,219, which issued to Hollenstein on Apr. 24, 1984. Hollenstein discloses a release valve that can be incorporated into a wall of a package. The release valve has a body defining a recess and a diaphragm positioned along a closed end of the recess. The closed end includes a plurality of apertures. The diaphragm is displaceable from the closed end to vent pressures generated in the packaging in the order of 1 to 2 millibar. The valve as disclosed in Hollenstein, however, does not contemplate the use of the valve in a heated environment.

Accordingly, it remains desirable to provide a release valve for use with packaging that maintains a sealed environment within the packaging during storage and vents pressurized gases during heating.

SUMMARY OF THE INVENTION

According to one aspect of the invention, a valve assembly is provided for venting pressurized gases generated from within an enclosed package during a heating of the package. The valve assembly includes a tubular body, a retaining member and a membrane element. The tubular body has an open end and a closed end. The tubular body defines a recess between the open and closed ends. The closed end has an aperture for venting the pressurized gases therethrough. The retaining member is operative for snap-fit engagement with the tubular body. The retaining member is spaced from the closed end of the tubular body. The membrane element is positioned between the closed end of the tubular body and the retaining member. The membrane element is positioned along the closed end to maintain a substantially sealed environment within the packaging. The membrane element is displaceable from the closed end to allow pressurized gases to pass through the aperture. The membrane element is formed from cast polypropylene so as to not permanently deform during heating of the package.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

The present invention provides a pressure release valve for use with packaging of microwavable food items. When used with packaging for microwavable food items, the release valve opens to relieve pressure generated within the packaging when heated in an oven, such as a microwave, beyond a preselected temperature or pressure range.

Figure 1:
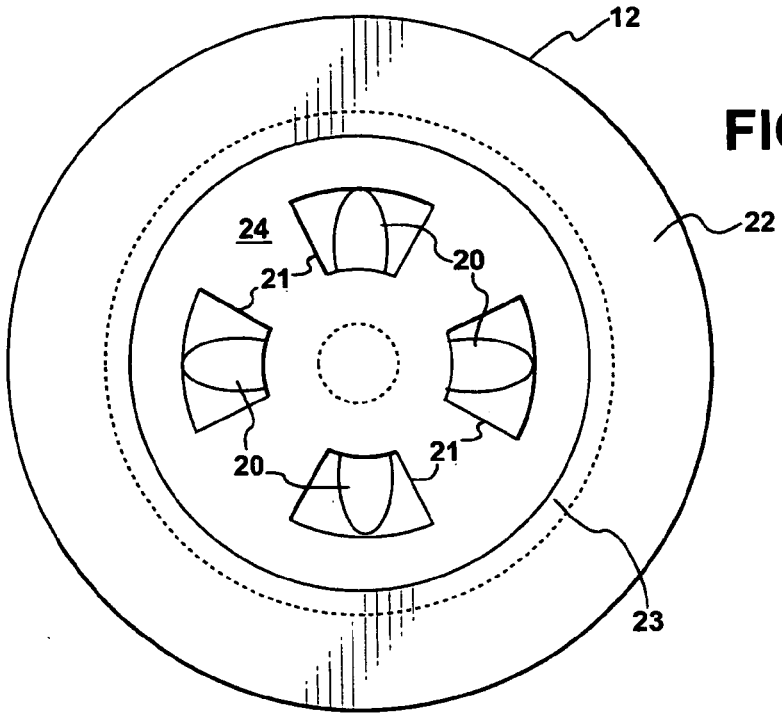
FIG. 1 is a top elevational view of a valve body of a release valve assembly according to the invention.
Figure 2:
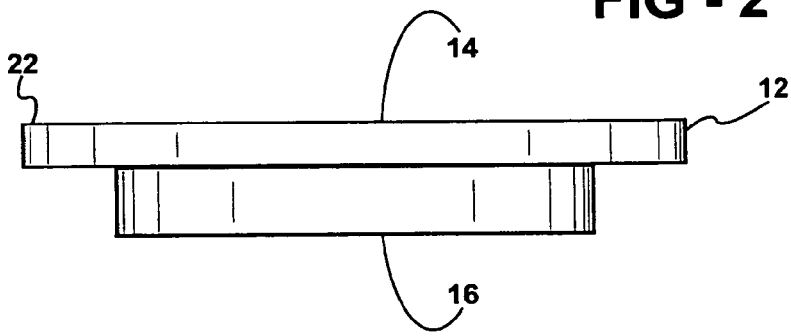
FIG. 2 is a side elevational view of the valve body of FIG. 1.
Figure 3:
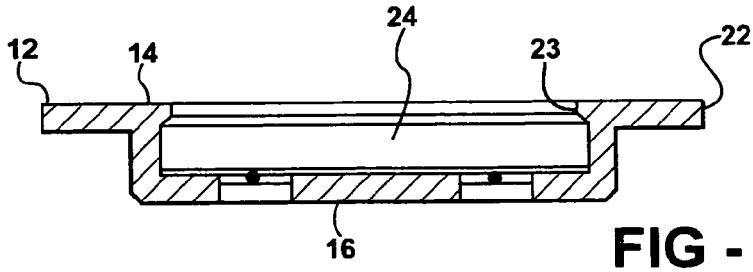
FIG. 3 is a cross-sectional view of the valve body of FIG. 1.
Figure 4:
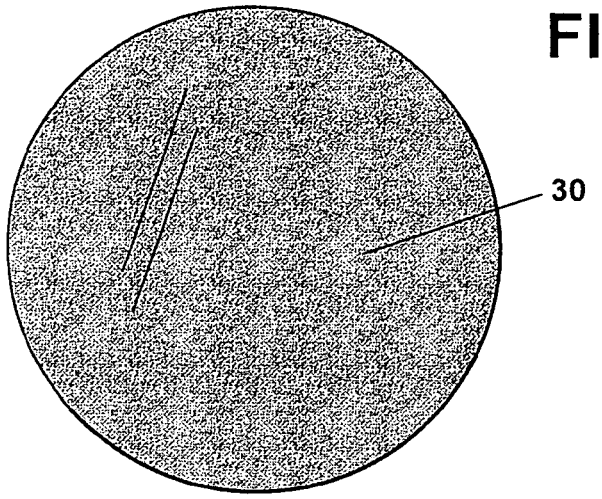
FIG. 4 is a top elevational view of a membrane element of the release valve assembly.
Figure 5:
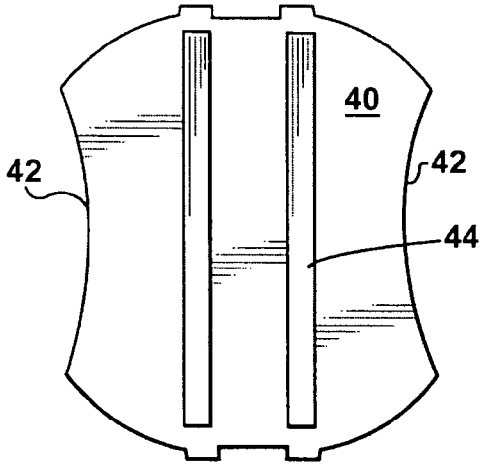
FIG. 5 is a top elevational view of a retaining member of the release valve assembly.
Figure 6:
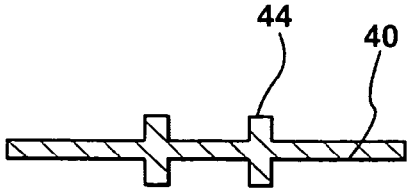
FIG. 6 is a side elevational view of the retaining member.
Figure 7:
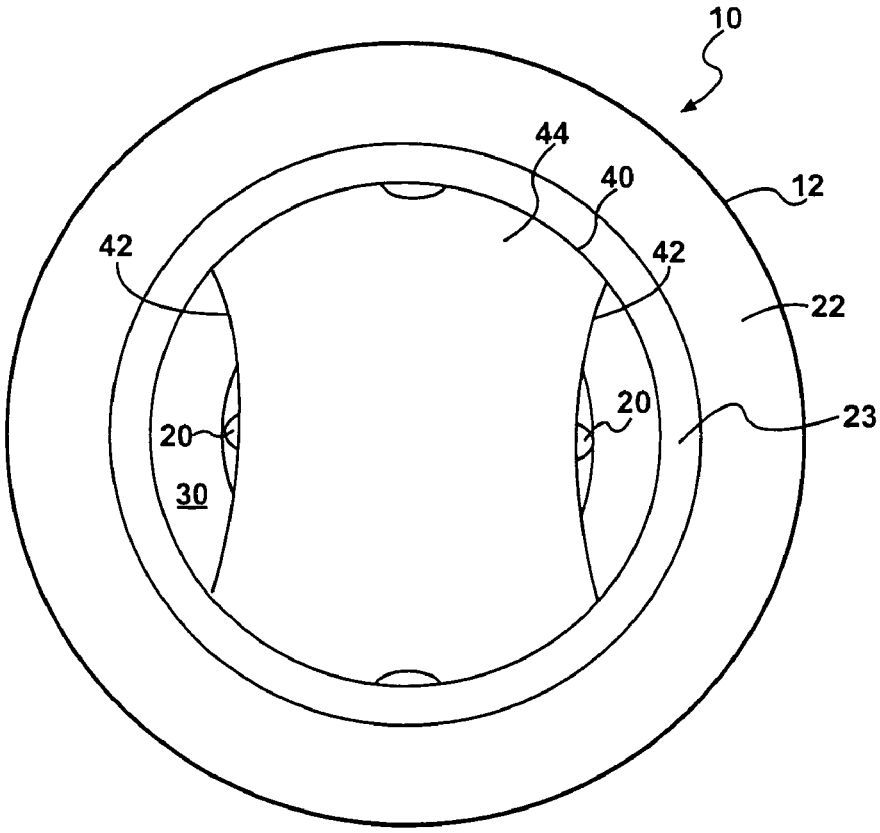
FIG. 7 is a top elevational view of the release valve assembly, including the body of FIGS. 1–3, membrane member of FIG. 4, and the retaining member of FIGS. 5–6.
Figure 8:
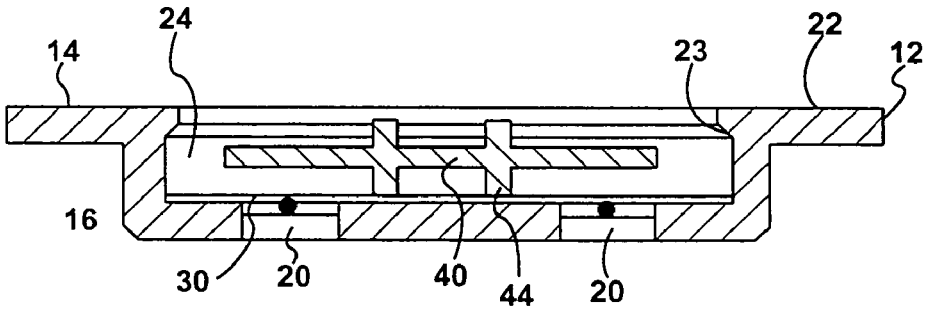
FIG. 8 is a cross sectional view of the release valve assembly of FIG. 7.

Referring to FIG. 1, the inventive pressure release valve assembly is generally indicated at 10. The release valve 10 includes a tubular body 12 having an open end 14 and a closed end 16. The closed end 16 includes at least one aperture 20 for venting pressurized gas and/or steam, as described in greater detail below. A sector-shaped recess 21 corresponding to the aperture 20 is formed in the closed end 16. The aperture 20 is formed at a bottom surface of the recess 21. Preferably, four petal-shaped apertures 20 are formed in the closed end 16 of the body 12, each being positioned within its own respective recess 21. Most preferably, apertures 20 having a collective area ranging between 12–24 $mm^2$. For example, in one particular embodiment each aperture 20 has an approximate width of 1.8 mm and approximate length of 2.6 mm. The shape and size of the apertures 20 permits the pressure to be rapidly exhausted. The body 12 can have any suitable cross-sectional shape, such as square, oval, octagonal, and triangular. However, as shown in the figures, the body 12 preferably has a circular cross-sectional shape.

A flanged portion 22 is defined along the open end 14 of the body 12. The flanged portion 22 is annular and extends radially outwardly from the open end 14. The flanged portion 22 is also concentric with the body 12. The flanged portion 22 includes an inside edge defining a rim 23. The rim 23 has a diameter less than that of the body 12. A recessed portion 24 is defined by the walls of the body 12 and has a depth defined between the rim 23 of the flanged portion 22 and the closed end 16.

The release valve assembly 10 also includes a membrane element 30. The membrane element 30 is operative to be received and seated into the recessed portion 24 of the body 12. More specifically, the membrane element 30 seats adjacent the closed end 16 of the body 12.

The release valve assembly 10 also includes a retaining member 40. The retaining member 40 is operative to be received in the recessed portion 24 of the body 12 in snap-fit engagement with the rim 23 of the flanged portion 22. The retaining member 40 is disc-shaped and has a side having at least one rib 44 protruding outwardly therefrom. A portion of the membrane element 30 is held between the rib 44 and the closed end 16 while the retaining member 40 is engaged with the rim 23. The remainder of the membrane element 30 remains deformable and displaceable from the closed end 16 by gases vented through the apertures 20.

The retaining member 40 has at least one concave edge 42. The concave edge 42 facilitates removal of the retaining member 40 from the recessed portion 24, by allowing a fingernail or other similarly shaped instrument to pry the concave edge 42 up from and out of the recessed portion 24 of the body 12.

Each part of the release valve assembly 10, particularly the membrane element 18, is formed of a cast polypropylene material. The release valve assembly 10 is used with packaging containing microwavable food items. Below a threshold temperature range of 130–180° C. or pressure range of less than 4–7.5 mbars the membrane element 30 remains flat and is seated adjacent the closed end 16 substantially sealing the apertures 20. When the packaging is heated above the threshold temperature range or the pressure exceeds the threshold pressure, the gases deform or displace at least a portion of the membrane element 30 from the closed end 16 allowing gas to vent through the apertures 20. After the pressure within the packaging has equalized with ambient air, the membrane element 30 returns to its start position adjacent the closed end 16 sealing the apertures 20 from further gas exchange.

Figure 9:
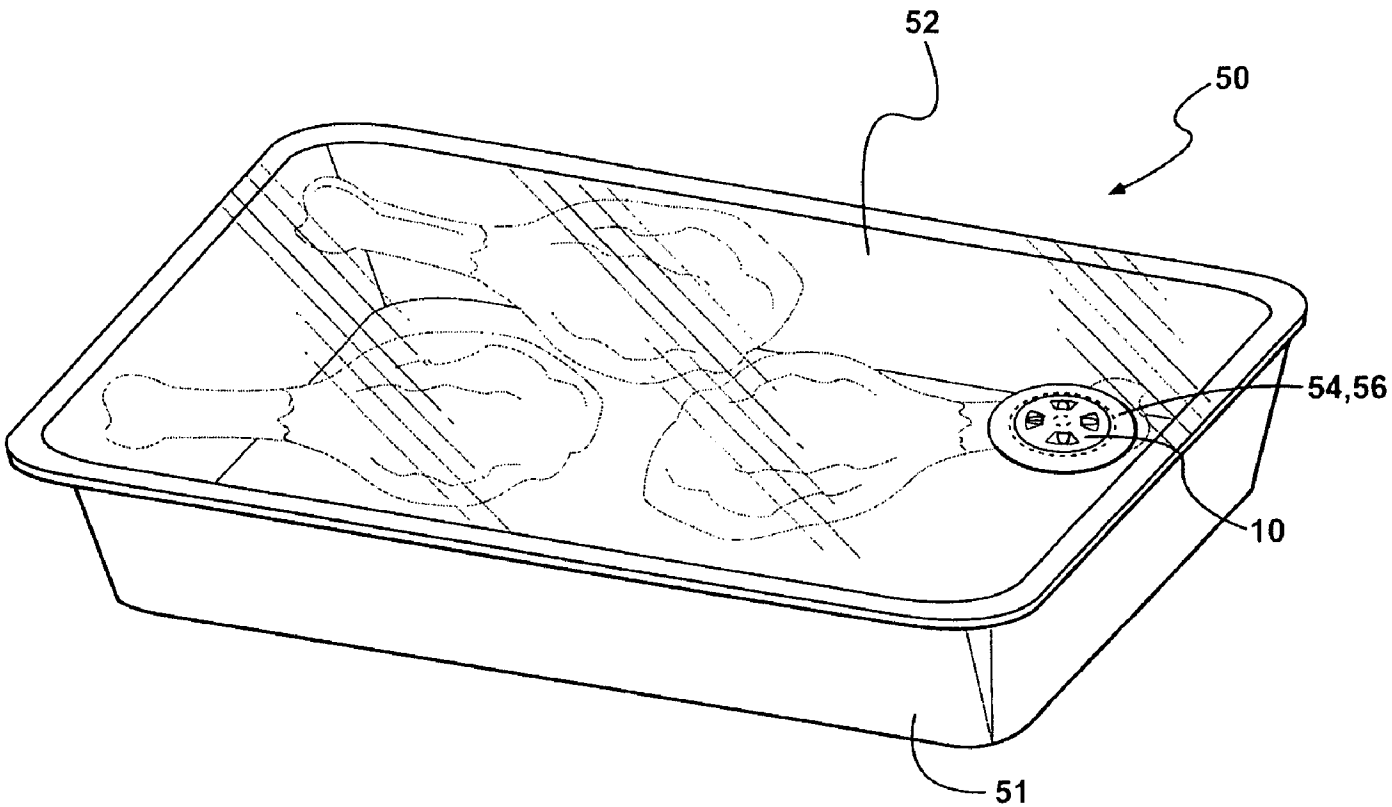
FIG. 9 is a perspective view of a package for food items incorporating the release valve assembly of FIG. 7.

Referring to FIG. 9, the release valve assembly 10 can be incorporated into the packaging 50 for the food items. Typically, the packaging 50 includes a container 51 and a sealing film 52. An aperture 54 is formed in the sealing film 52. The aperture 54 is defined by a continuous inner edge 56. The inner edge 56 corresponds in shape to the flanged portion 22 of the body 12. The flanged portion 22 is secured along the inner edge 56 of the sealing film 52 by heating, ultrasonic welding, or similar processes. The container 51 is filled with food items. The sealing film 52 is wrapped over the food items and secured to the container 51 by heating sealing or any similar process known by those having ordinary skill in the art. The packaging 50 is stored until ready for use, during which time, the membrane element 30 remains seated against the closed end 16 of the body 12 to prevent any gas exchange through the apertures 20. Optionally, the packaging 50 may include a pressure gauge or indicator to provide information relating to the pressure levels inside of the packaging 50 to the user.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

The invention claimed is:

1. A valve assembly for venting a pressure generated by a gas within an enclosed package containing a food product during a heating of the package, said valve assembly comprising:

a tubular body having an open end and a closed end, said tubular body defining a recess between said open and closed ends, said closed end having an aperture for venting the pressure therethrough, and said open end having a flanged portion extending radially outwardly, and that is sealed to an inner edge of an aperture in the package;

a retaining member operative for snap-fit engagement with said tubular body, wherein a side of said retaining member adjacent said closed end of said tubular body includes an outwardly protruding rib, and said retaining member is spaced apart from said closed end of said tubular body; and a generally planar membrane element positioned between said closed end of said tubular body and said retaining member and held in place by the rib on said retaining member, to maintain a substantially sealed environment within the package when the pressure in the package is less than a predetermined threshold pressure range of 4–7.5 mbar, and a portion of said membrane element not held by the rib on said retaining member is deformable from an initial position adjacent said closed end while venting the gas through the aperture in said closed end when the pressure in the package exceeds the predetermined threshold pressure range during heating of the package and the deformed portion of the membrane element returns to the initial position adjacent the closed end to seal the apertures when the pressure in the package has equalized with ambient air pressure, and said membrane element is formed from cast polypropylene so as to not permanently deform from heating of the package.

2. The valve assembly as set forth in claim 1, wherein said tubular body includes a rim formed along at least a portion of said flanged portion and operative for snap-fit engagement with said retaining member.

3. The valve assembly as set forth in claim 2, wherein said flanged portion includes an inside edge, said rim being formed along said inside edge.

4. The valve assembly as set forth in claim 3, wherein said tubular body is cylindrically shaped.

5. The valve assembly as set forth in claim 2, wherein said rim has a diameter smaller than that of said tubular body.

6. The valve assembly as set forth in claim 3, wherein said recess includes a depth defined between said inside edge and said closed end of said tubular body.

7. The valve assembly as set forth in claim 1, wherein said retaining member has at least one concave edge that facilitates a removal of said retaining member from said recess.

8. The valve assembly as set forth in claim 1, wherein said closed end includes a plurality of apertures for venting the pressure generated by the food product therethrough when the temperature exceeds a predetermined threshold temperature range of 130°–180° C.

9. The valve assembly as set forth in claim 1, wherein said aperture has a substantially sector shape with a diameter of 1.8 mm and a length of 2.6 mm.

10. The valve assembly as set forth in claim 1, wherein said retaining member includes at least one rib extending between opposite sides thereof.

11. A heatable, sealed package for heating a food product contained within the heatable, sealed package, the heatable, sealed package comprising:

a container for the food product;

a sealing film having a continuous inner edge defining an aperture, wherein said sealing film is sealed to said container;

a tubular body having an open end and a closed end, said tubular body defining a recess between said open and closed ends, wherein said closed end includes four apertures for venting a pressure generated by a gas therethrough, and each aperture has a substantially sector shape with a diameter of 1.8 mm and a length of 2.6 mm, wherein said open end of said tubular body includes a flanged portion extending radially outwardly, and that is sealed to the inner edge of the aperture in said sealing film;

a retaining member operative for snap-fit engagement with said tubular body, wherein a side of said retaining member adjacent said closed end of said tubular body includes an outwardly protruding rib, and said retaining member is spaced apart from said closed end of said tubular body; and a generally planar membrane element positioned between said closed end of said tubular body and said retaining member, and held in place by the rib on said retaining member to maintain a substantially sealed environment within the package when the pressure in the package is less than a predetermined threshold pressure range of 4–7.5 mbars, and a portion of said membrane element not held by the rib on said retaining member is deformable from an initial position adjacent said closed end while venting the gas through the aperture in said closed end when the pressure in the package exceeds the predetermined threshold pressure during heating of the package and the deformed portion of the membrane element returns to the initial position adjacent the closed end to seal the apertures when the pressure in the package has equalized with ambient air pressure, and said membrane element is formed from cast polypropylene so as to not permanently deform from heating of the package.

12. The package as set forth in claim 11, wherein said tubular body includes a rim formed along at least a portion of said flanged portion and operative for snap-fit engagement with said retaining member.

13. The package as set forth in claim 12, wherein said flanged portion includes an inside edge, said rim being formed along said inside edge.

14. The package as set forth in claim 13, wherein said tubular body is cylindrically shaped.

15. The package as set forth in claim 12, wherein said rim has a diameter smaller than that of said tubular body.

16. The package as set forth in claim 13, wherein said recess includes a depth defined between said inner edge and said closed end of said tubular body.

* * * * *